United States Patent [19]

Sanders

[11] 4,330,901

[45] May 25, 1982

[54] ADJUSTABLE HINGE

[76] Inventor: Forest E. Sanders, 210 Pershing St., Green City, Mo. 63545

[21] Appl. No.: 169,890

[22] Filed: Jul. 17, 1980

[51] Int. Cl.[3] ..... E05D 7/04

[52] U.S. Cl. ..... 16/237

[58] Field of Search ..... 16/129, 130, 168, 128 R; 403/59, 61, 63, 75, 161, 163

[56] References Cited

U.S. PATENT DOCUMENTS

| | | | |
|---|---|---|---|
| 2,984,249 | 5/1961 | Sears, Jr. et al. | 403/75 |
| 3,378,060 | 4/1968 | Oddicini et al. | 16/128 R |
| 3,810,462 | 5/1974 | Szpur | 403/59 X |

FOREIGN PATENT DOCUMENTS

| | | | |
|---|---|---|---|
| 1340690 | 9/1963 | France | 16/130 |

*Primary Examiner*—Werner H. Schroeder
*Assistant Examiner*—Andrew M. Falik
*Attorney, Agent, or Firm*—Morton S. Adler

[57] ABSTRACT

A hinge unit is provided for doors and casement windows by an arrangement of four like pins each having a shank extending from an enlarged head. A first pin with a threaded bore through the head has the shank threadably secured to the door or window so that the bore therein is horizontal. A second pin with a like threaded bore through the head has its shank threadably secured to the first pin with the bore in the second pin vertically disposed. A third pin with an oversized smooth bore through the head has its shank threadably secured to the wall adjacent the door or window with the bore vertical. The head of the third pin is disposed above the head of the second pin so that the respective bores are in registration. The fourth pin has its shank journalled through the oversized bore of the third pin and threadably engaged in the head of the second pin. In an alternative arrangement, as a matter of choice, the second pin may be secured to the wall and the third pin secured to the first pin. The amount of threaded penetration of the respective pins with each other and with the door, window or wall can be selectively altered for adjustment relative to sagging or proper alignment. Threads on the respective shanks may be preformed or, for economy in fabrication, the pins can be of a suitable malleable material whereby the shank threads are formed when engaged in threaded holes formed in the door, window and wall.

6 Claims, 11 Drawing Figures

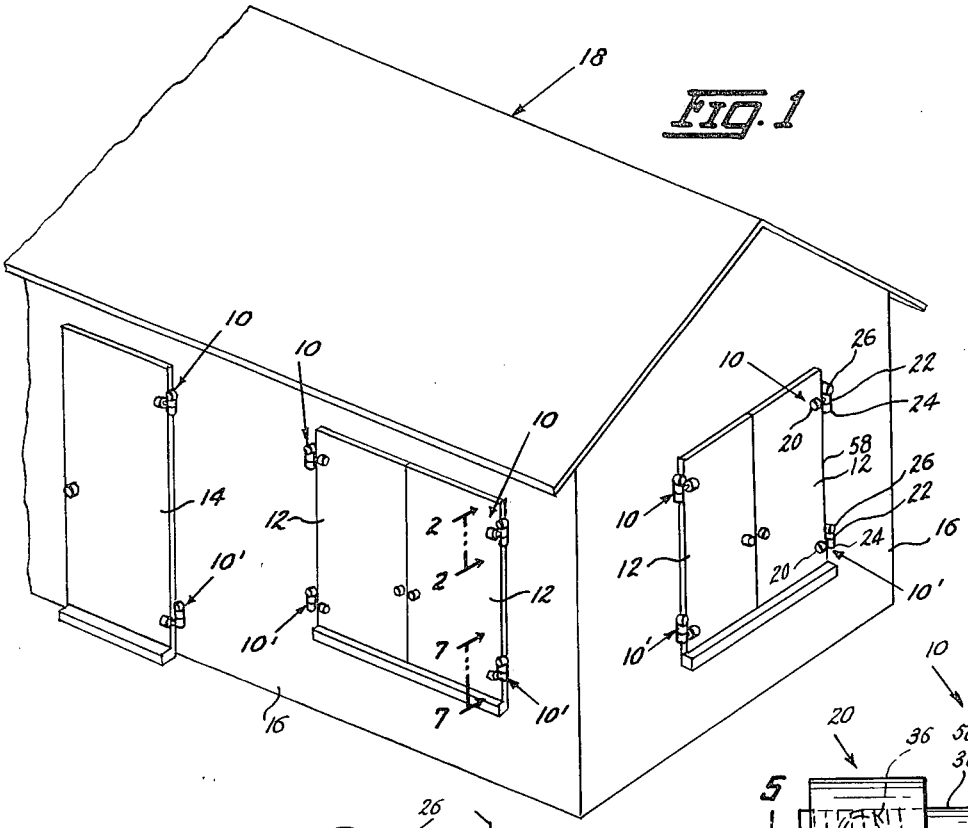
FIG. 1
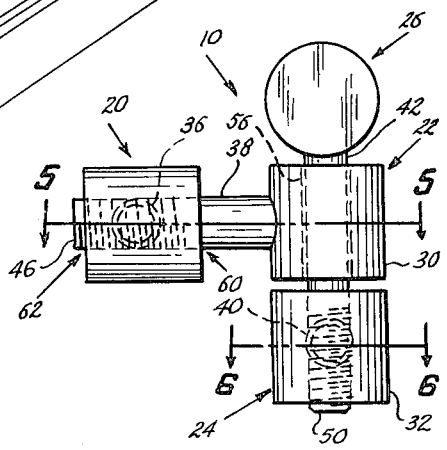
FIG. 2
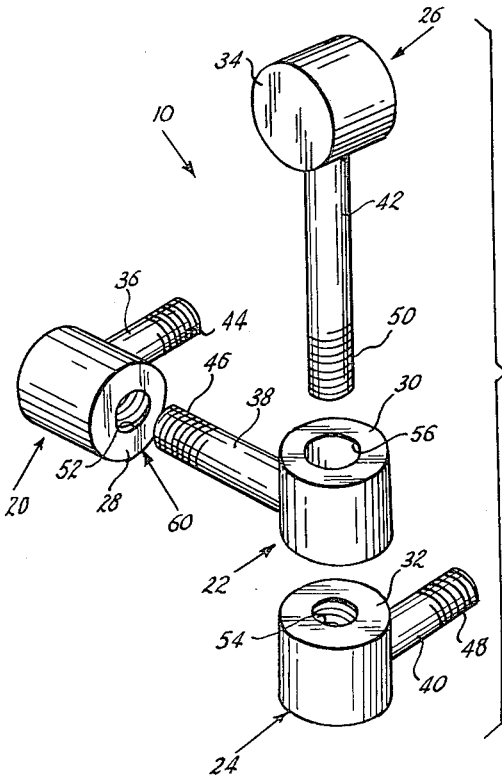
FIG. 4
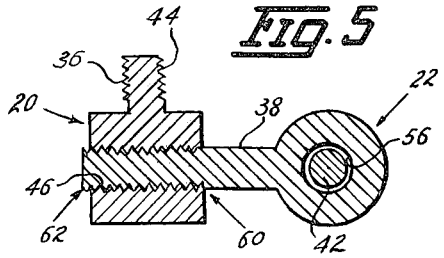
FIG. 5
FIG. 3
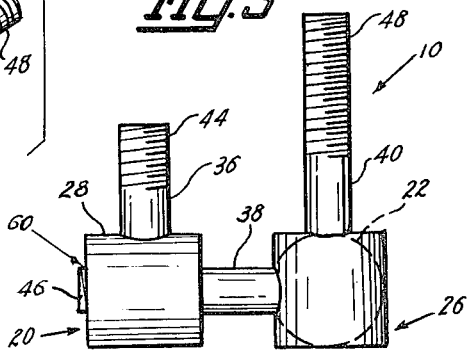
FIG. 6
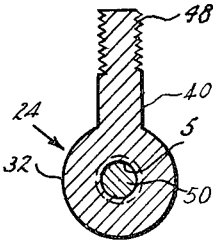

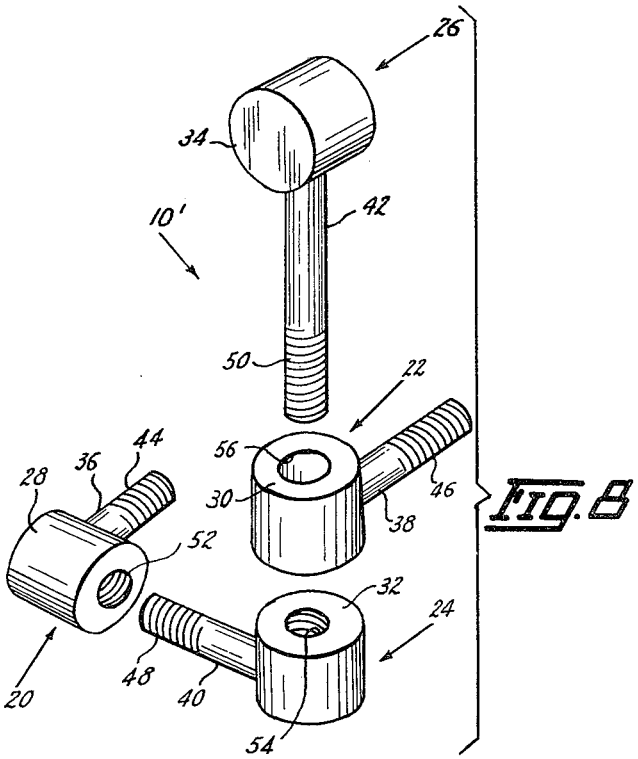
FIG. 8
FIG. 7
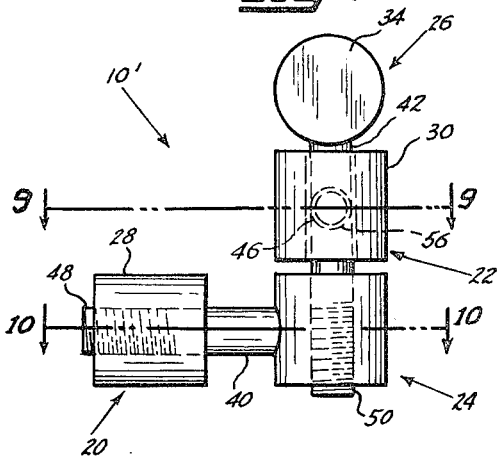
FIG. 11
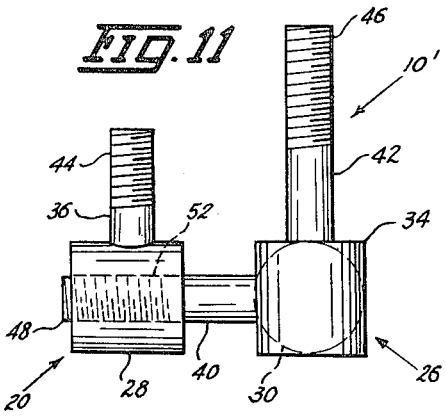
FIG. 10
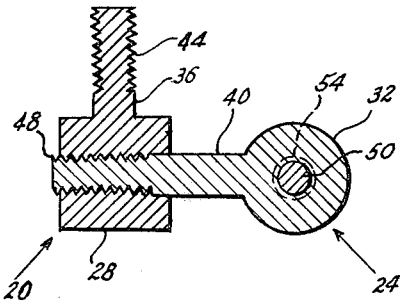
FIG. 9
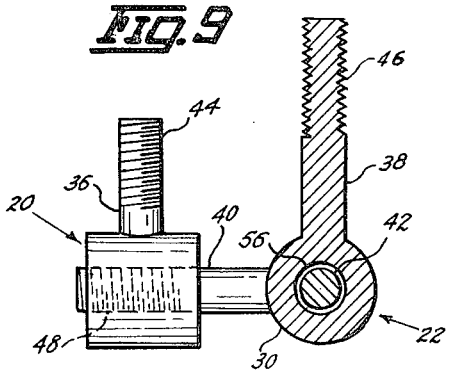

ADJUSTABLE HINGE

BACKGROUND OF THE INVENTION

This invention relates to a novel hinge unit for doors and casement type windows.

Traditional hinges mounted to the jamb of a window or door and the abutting edge of such window or door require a certain amount of skill for proper attachment and alignment that the non-expert usually does not have and one of the important objects of the present invention is to provide a novel hinge unit that can be simply, easily and quickly installed without the requirement for any special skills.

More particularly, it is an object herein to provide a novel hinge comprising four like headed pins for which three are selectively secured to the window or door and to the adjacent wall of the building in an arrangement which disposes two of the respective heads in alignment for hinged connection by the fourth pin to complete the hinge assembly.

Another object herein is to provide a hinge unit of the above class wherein the several pins are individually adjustable in their respective attachments to the door, window, wall or to each other for a limited correction in the alignment of such door or window as may be required due to sagging or otherwise.

A further object is to provide a hinge unit as characterized that is formed from a plurality of like parts affording economy in manufacture.

The foregoing objects and such further objects as may appear herein, or be hereinafter pointed out, together with the advantages of this invention will be more fully discussed and developed in the more detailed description of the accompanying drawings.

BRIEF DESCRIPTION OF THE DRAWINGS

FIG. 1 is a fragmentary perspective view of a house showing a door and casement windows thereon supported by the hinge unit of this invention, FIG. 2 is a front elevational view of the upper hinge taken from the line 2—2 of FIG. 1, FIG. 3 is a top plan view of the hinge in FIG. 2, FIG. 4 is an enlarged exploded perspective view of the several hinge components shown in FIG. 2, FIG. 5 is a cross sectional view taken on the line 5—5 of FIG. 2, FIG. 6 is a cross sectional view taken on the line 6—6 of FIG. 2, FIG. 7 is a front elevational view of the lower hinge taken from the line 7—7 of FIG. 1, the difference from the hinge in FIG. 2 being only a different directional orientation of the two lower hinge components as a matter of choice, FIG. 8 is an enlarged exploded perspective view of the hinge shown in FIG. 7 to illustrate the different position of the two lower components relative to FIG. 4, FIG. 9 is a cross sectional view taken on the line 9—9 of FIG. 7, FIG. 10 is a cross sectional view taken on the line 10—10 of FIG. 7, and FIG. 11 is a top plan view of the hinge shown in FIG. 7.

DESCRIPTION OF THE PREFERRED EMBODIMENTS

Referring to the drawings, this new hinge is designated generally by the numeral 10 as best seen in FIG. 4 and as also seen in FIG. 8, designated 10', where two of the hinge components are differently oriented as a matter of choice with no change in structure or function. Such hinges are adapted more particularly for use on a swingable member such as casement windows 12 and doors 14 mounted to a fixed member such as wall 16 of building 18 as illustrated in FIG. 1.

Hinges 10, 10' are of like construction so that like parts are given like numbers in the description to follow. Such hinges are formed by an arrangement of four like shaped pins, 20, 22, 24 and 26 each having the respective head 28, 30, 32, 34 which may be of any suitable shape and is preferably shown as cylindrical and from which there extends the respective shanks 36, 38 40, 42 that are externally threaded on their respective free ends 44, 46, 48, 50. Such threaded ends in some forms of use for hinges 10, 10', as will later appear, may be simply and economically formed by the use of malleable pin material whereby the threads are formed as the shanks are turned into threaded holes in their receiving members. The size and shape of the respective heads on the several pins 20, 22, 24, 26 and the diameter of the respective shanks are preferably correspondingly the same for economy in manufacture but this is not necessarily required. Heads 28, 32 on pins 20, 24 are provided with respective through threaded bores 52, 54 for reception of certain threaded shanks and head 30 on pin 22 is provided with a through smooth bore 56 that is oversized in relation to the diameter of shank 42 on pin 26 as will be further explained in more detail.

The window 12 and door 14 in FIG. 1 are shown with the customary two hinge mountings in an upper and lower relationship with hinge 10 used for the upper mounting and hinge 10' used for the lower mounting and it will be understood that lesser or greater number of hinges may be used depending on the size and weight of the member to be mounted thereby. It is also pointed out that both the upper and lower hinges may be either hinge 10 or hinge 10' or reversed from that shown in FIG. 1 without any changes in formation or function.

With reference more particularly to FIGS. 1-6, hinge 10 is described relative to its mounting on window 12 and such mounting is correspondingly the same for door 14. Shank 36 of pin 20 is threadably engaged at end 44 with the front or outer surface of window 12 near the edge 58 to be hinged as shown in FIG. 1 so that the axis of bore 52 in head 28 is on a horizontal plane. In such position, for purpose of description, bore 52 defines an outer end 60 oriented towards window edge 58 and an inner edge 62 oriented in the opposite direction. Shank 38 of pin 22 is threadably engaged at end 46 with the bore 52 of pin 20 at end 60 so that head 30 is disposed outwardly from window edge 58 in close proximity to wall 16 and bore 56 in head 30 is vertically disposed. Pin 24 is immediately below pin 22 with shank 40 threadably engaged at end 48 with wall 16 and with bore 54 vertically disposed in registration with bore 56 in pin 22. Thus far described, window 12 is secured to the hinge unit by pins 20, 22 and pin 24 is secured to the building wall 16. With head 30 of pin 22 and head 32 of pin 24 aligned for registration of the respective bores 56, 54, shank 42 of pin 26 is journalled through the oversized bore 56 in pin 22 with end 50 threadably engaged in bore 54 of pin 24 to complete the connection of hinge 10 to window 12 and wall 16 where the oversized bore 56 in pin 22 permits head 30 to rotate about shank 42 of pin 26 as the window 12 is opened or closed. By selectively adjusting the depth of penetration of any one or more of the several pin shanks 36, 38, 40, 42, the vertical and horizontal positions of window 12 can be adjusted to a limited degree as may be required due to sagging and the like. This is illustrated in FIG. 2 where the spacing shown between heads 30, 32 of pins 22, 24 can be increased or decreased by rotation of shank 42 on pin 26. Comparable adjustments can be made with the other pins.

With reference now to FIGS. 7–11 relative to hinge 10', the pins 20, 22, 24, 26 are of like construction as the like numbered pins in hinge 10 but differently arranged in part as a matter of choice with pin 22 of hinge 10' having its shank end 46 secured to wall 16 instead of to pin 20 on the window 12 as in hinge 10 and pin 24 in hinge 10' is secured to pin 20 instead of to wall 16 as in hinge 10. Thus, hinges 10, 10', while functionally the same, afford a variation in appearance that can be utilized, if desired. It can be noted that in hinge 10 as seen in FIG. 4, pin 22 with the oversized bore 56 is movable with pin 20 on window 12 as the window is opened and closed so that head 30 of pin 22 rotates about shank 42 of pin 26 attached to pin 24 that is immovable by attachment to wall 16 but that in hinge 10' as seen in FIG. 8, the position of pins 22, 24 are reversed so that pin 22 is immovable by attachment to wall 16 and pin 24 is movable with pin 20. Thus in hinge 10', head 32 of pin 24 with shank 42 of pin 26 attached will rotate relative to the oversized bore 56 in pin 22 as window 12 is opened or closed.

It is pointed out that hinges 10, 10' have been used to good advantage in the hobby field involving model buildings, such as doll houses, using Plexiglass, for example, for the window, door and wall members and in such situations, pins 20, 22, 24, 26 can, if desired, be made of a suitable malleable material such as plastic whereby the threaded ends 44, 46, 48, 50 are easily and economically formed by turning the pins into appropriate threaded holes in their receiving member. Accordingly, in view of the foregoing, it is thought a full understanding of the construction and operation of this invention will be had and the advantages of the same will be appreciated.

I claim:

1. A hinge for securing a swingable member such as a door or window to a fixed member such as a wall or casing, comprising:

a first pin attached to said swingable member, a second pin attached to said fixed member, a third pin attached to said first pin, said second and third pins each having an enlarged head disposed in vertical alignment defining an uppermost head and a lowermost head, said uppermost head provided with a through smooth bore, a fourth pin journalled through said smooth bore and secured to said lowermost head, and said smooth bore being oversized relative to said fourth pin.

2. A hinge as defined in claim 1 including the attachment of all of said respective pins being by means of a threadable engagement and each pin being selectively adjustable as to depth of penetration whereby the alignment of said swinging member can be selectively adjusted.

3. A hinge for securing a swingable member such as a door or window to a fixed member such as a wall or casing, comprising:

first, second, third and fourth pins each having an enlarged head and an integral shank extending therefrom, the shank of said first pin secured to said swingable member, the shank of said second pin secured to the head of said first pin, the shank of said third pin secured to said fixed member at a point where the head on said third pin is below and in registration with the head of said second pin, the head of said second pin provided with a through bore oriented in a vertical plane, the shank of said fourth pin journalled through the bore in said second pin and secured to the head of said third pin, and the bore in said second pin being oversized relative to the shank of said fourth pin.

4. A hinge as defined in claim 3 including:

the respective heads of said first and third pins being provided with axial threaded bores for threadably securing the respective shanks attached thereto, said first pin secured to said swingable member so that the bore in said first pin is on a horizontal plane, said third pin disposed so that the bore therein is on a vertical plane in registration with the bore in said second pin, and each threadably engaged shank being adjustable as to depth of penetration whereby the alignment of said swinging member can be changed due to sagging and otherwise.

5. A hinge for securing a swingable member such as a door or window to a fixed member such as a wall or casing, comprising;

first, second, third and fourth pins each having an enlarged head and an integral shank extending therefrom, the shank of said first pin secured to said swingable member, the shank of said second pin secured to said fixed member, the shank of said third pin secured to the head of said first pin at a point where the head on said third pin is below and in registration with the head of said second pin, the head of said second pin provided with a through bore oriented in a vertical plane, the shank of said fourth pin journalled through the bore in said second pin and secured to the head of said third pin, and the bore in said second pin being oversized relative to the shank of said fourth pin.

6. A hinge as defined in claim 5 including:

the respective heads of said first and third pins being provided with axial threaded bores for threadably securing the respective shanks attached thereto, said first pin secured to said swingable member so that the bore in said first pin is on a horizontal plane, said third pin disposed so that the bore therein is on a vertical plane in registration with the bore in said second pin, and each threadably engaged shank being adjustable as to depth of penetration whereby the alignment of said swinging member can be changed due to sagging and otherwise.

* * * * *